US010265635B2

(12) United States Patent
Tanous et al.

(10) Patent No.: US 10,265,635 B2
(45) **Date of Patent: *Apr. 23, 2019**

(54) PROPULSION SYSTEMS FOR A HOVERING TOY CREATURE

(71) Applicant: Tanous Works, LLC, Simpsonville, SC (US)

(72) Inventors: Gregory David Tanous, Forest Grove, OR (US); Ryan Aguilar, Banks, OR (US)

(73) Assignee: Tanous Works, LLC, Simpsonville, SC (US)

( * ) Notice: Subject to any disclaimer, the term of this patent is extended or adjusted under 35 U.S.C. 154(b) by 51 days.

This patent is subject to a terminal disclaimer.

(21) Appl. No.: 15/395,870

(22) Filed: Dec. 30, 2016

(65) Prior Publication Data

US 2017/0106305 A1 Apr. 20, 2017

Related U.S. Application Data

(63) Continuation of application No. 14/791,578, filed on Jul. 6, 2015, now Pat. No. 9,533,234, which is a continuation-in-part of application No. 14/277,902, filed on May 15, 2014, now Pat. No. 9,072,981.

(60) Provisional application No. 62/116,616, filed on Feb. 16, 2015, provisional application No. 61/875,653, filed on Sep. 9, 2013, provisional application No. 61/823,861, filed on May 15, 2013.

(51) Int. Cl.

| | |
|---|---|
| ***A63H 27/127*** | (2006.01) |
| ***A63H 27/00*** | (2006.01) |
| ***A63H 30/04*** | (2006.01) |

(52) U.S. Cl.
CPC ..... *A63H 27/008* (2013.01); *A63H 30/04* (2013.01)

(58) Field of Classification Search
USPC ..... 434/34, 36, 37, 45, 62, 330, 368, 376, 434/390; 446/34, 36, 37, 45, 62, 330, 446/368, 376, 390
See application file for complete search history.

(56) References Cited

U.S. PATENT DOCUMENTS 559,536 A * 5/1896 Nesbit ..... A63H 7/06 446/294
964,803 A * 7/1910 Olson ..... A63H 3/18 446/361

(Continued)

*Primary Examiner* — Kurt Fernstrom
(74) *Attorney, Agent, or Firm* — Stephen E. Kelly; Hill Ward Henderson, P.A.

(57) ABSTRACT

A hovering toy creature having a propulsion system, a control system, a winged body, and a wing actuation assembly. The winged body is mounted to the propulsion system, which is controlled by the control system. The wing actuation assembly is mounted to the winged body, and the wing actuation assembly is powered by the control system. The wing actuation assembly drives the wings in an oscillating flapping motion. The wings comprise apertures permitting air passage through the wing, thus reducing the aerodynamic effect of the flapping motion. In this manner, the wings produce a "bouncing" flight action, thus creating a realistic flight motion. In another embodiment, the propulsion system comprises one or more rotors in a coaxial arrangement. The hovering toy creature is operated by either a wireless control device or a timer device.

15 Claims, 14 Drawing Sheets

(56) References Cited

U.S. PATENT DOCUMENTS 2,504,567 A * 4/1950 Morgan ..... A63H 29/18 446/18
3,038,274 A * 6/1962 Chirhart ..... A63H 7/04 446/287
3,626,555 A * 12/1971 Albertini ..... A63H 27/008 446/35
4,244,138 A * 1/1981 Holahan ..... A63H 13/02 446/300
4,654,018 A * 3/1987 Farrington ..... A63H 27/14 446/308
4,729,748 A * 3/1988 Van Ruymbeke ..... A63H 29/18 446/121
4,988,320 A * 1/1991 Rankin ..... A63H 3/003 446/376
5,163,861 A * 11/1992 Van Ruymbeke ... A63H 27/008 244/11
5,964,638 A * 10/1999 Emerson ..... A63H 7/00 446/339
6,206,324 B1 * 3/2001 Smith ..... B64C 33/02 244/72
D463,510 S * 9/2002 Weiser ..... D21/585
6,540,177 B2 * 4/2003 Woo ..... B64C 33/00 244/11
6,572,428 B1 * 6/2003 Weiser ..... A63H 13/02 116/169
6,632,119 B2 * 10/2003 Chernek ..... A63H 29/18 244/72
6,802,473 B2 * 10/2004 Charron ..... B64C 33/02 244/11
6,840,477 B2 * 1/2005 Hamamoto ..... B64C 33/02 244/22
6,938,853 B2 * 9/2005 Pines ..... B64C 33/02 244/11
7,255,305 B2 * 8/2007 Earl ..... B64C 33/02 244/11
7,536,823 B2 * 5/2009 Brint ..... A01M 31/06 40/417
7,895,779 B2 * 3/2011 Schnuckle ..... A63H 13/02 119/708
8,286,907 B2 * 10/2012 Dohi ..... B64C 31/036 244/13
8,382,546 B2 * 2/2013 Van Ruymbeke ... A63H 27/008 244/11
8,602,348 B2 * 12/2013 Bryant ..... B64C 29/0033 244/12.4
2012/0115390 A1 * 5/2012 Fuchiwaki ..... A63H 27/008 446/35

* cited by examiner

PROPULSION SYSTEMS FOR A HOVERING TOY CREATURE

CROSS-REFERENCE TO RELATED APPLICATION

Pursuant to 35 U.S.C. § 120, this application is a continuation application of U.S. patent application Ser. No. 14/791,587, filed on Jul. 6, 2015, now U.S. Pat. No. 9,533,234, which pursuant to 35 U.S.C. § § 119(e) and 120:

(a) is a continuation-in-part of U.S. patent application Ser. No. 14/277,902, filed on May 15, 2014, now U.S. Pat. No. 9,072,981, which claimed the benefit of U.S. Provisional Patent Application Ser. No. 61/823,861, filed on May 15, 2013, and the benefit of U.S. Provisional Patent Application Ser. No. 61/875,653, filed on Sep. 9, 2013; and (b) claims the benefit of U.S. Provisional Patent Application Ser. No. 62/116,616, filed on Feb. 16, 2015, the entire contents of each of which are incorporated herein by this reference.

BACKGROUND

1. Field of Invention

The present invention relates generally to the field of remote controlled flying toys, and more particularly, to a hovering toy creature that simulates the flight of birds, insects, reptiles, mammals, and mythical creatures having wings that support flight in a flapping motion.

2. Description of Related Art

Past winged toy creatures rely on rapidly flapping wings to create lift and corresponding flight. These toys commonly rely on ornithopter-style flapping assemblies, and they are usually unstable and difficult to maneuver. In addition, the arrangement of wings in these toy creatures does not produce a realistic flight simulation of the actual figure. Instead, these toys appear to be mechanical and awkward in appearance during flight.

The present invention seeks to overcome these deficiencies by providing a wing flapping assembly that produces a realistic simulation of flight.

SUMMARY OF THE PREFERRED EMBODIMENTS

The hovering toy creature comprises a propulsion system, a control system, a winged body, and a wing actuation assembly. The winged body is mounted to the propulsion system, which is controlled by the control system. The wing actuation assembly is mounted to the winged body, and the winged actuation assembly is powered by the control system, which comprises all of the electrical components for operation of the remote controlled toy creature. The propulsion system comprises any one of a number of known remote controlled, propeller driven lift units.

The winged body generally comprises one or more side panels and two or more wings. The wings are configured either with or without apertures that enable the passage of air through the wings. In effect, the apertures remove surface area from the wings, thus reducing the aerodynamic forces generated by the wings during the flapping motion. The wings comprise a first spine to provide form and stiffness to the wing material. The first spine has a base and a distal end, wherein the base connects to the wing actuation assembly, as described below.

In some embodiments, it is preferable for the wing to comprise a second spine, which simulates the second finger or third finger of a Chiropteran-style wing. The second spine is attached to the wing in proximity to the second finger or third finger of the wing. The first and second spines are oriented on the wing such that the spines cross tips in the proximity of the wrist of the wing, with the distal end of the first spine crossing above the tip of the second spine. The first spine and the second spine are separated to form a flex zone between the attachment means of the respective spines. On the upstroke of the wing, the wing actuation assembly lifts the first spine, and the wing bends at the flex zone such that the wing distal end droops as the wing is raised. At the top of the upstroke, the wing distal end snaps to an upright position due to its momentum, and the down stroke of the flapping cycle begins again. During the down stroke of the wing, the wing distal end straightens out, and the second spine abuts the crossing first spine such that the first and second spines provide stiffness across the flex zone along the full length of the wing. In this manner, when the wing droops on the upstroke and straightens on the down stroke, the action of the wing appears more realistic during flight of the toy creature.

The wing actuation assembly comprises the components necessary to actuate wing movement in a flapping motion. For example, in one embodiment the wing actuation assembly comprises a frame having a base, vertical struts, and a servo. The servo has a rotating arm, which is connected to a linking assembly. As the arm rotates, the motion of the arm drives the linking assembly up and down in a cyclical manner, which drives the wings up and down in the flapping movement. During flight, the flapping wings cause a "bouncing" effect, making the hovering toy creature appear to be life-like during flight. The bouncing effect becomes more pronounced when there are no wing apertures, or when such apertures are relatively small. The bouncing effect is minimized, or even eliminated, when the area of the apertures approaches that of the overall wing surface area. To further enhance the life-like appearance of the hovering toy creature, the wings pivot about an axis that is inclined at an angle ranging from about 15-degrees to about 75-degrees as measured from horizontal.

In one embodiment, the propulsion system comprises a first rotor and a second rotor configured in a co-axial orientation. A motor drive unit drives the first rotor and the second rotor via at least one rotor mast. The propulsion system further comprises a housing disposed around the rotor mast for providing lateral support to the rotor mast. The housing can be configured in the shape or form of a figure seated on the body and riding the hovering toy creature.

In another embodiment, the propulsion system and the wing actuation assembly placed in operative engagement by a worm device and a worm wheel.

In another embodiment, the control system comprises a timer device to control the propulsion system, and the control device is not in communication with a wireless control device.

Those skilled in the art will appreciate that the figures are not intended to be drawn to any particular scale; nor are the figures intended to illustrate every embodiment of the invention. The invention is not limited to the exemplary embodiments depicted in the figures, or to the shapes, relative sizes, or proportions shown in the figures.

DETAILED DESCRIPTION OF THE PREFERRED EMBODIMENTS

With reference to the drawings, the invention will now be described with regard to the best mode and the preferred embodiment. In general, the device is a remote-controlled, hovering toy creature in the shape of a winged bird, reptile, mammal, or mythical creature, wherein the flapping wings simulate flight of the figure. The embodiments disclosed herein are meant for illustration and not limitation of the invention. An ordinary practitioner will appreciate that it is possible to create many variations and combinations of the following embodiments without undue experimentation.

By way of example and not limitation, the following discussion will generally present the hovering toy creature 99 in the context of a dragon-shaped body. However, it will be appreciated that the hovering toy creature 99 may take the form of a variety of other creatures, such as bird, reptile, mammal, or mythical creature. As used herein, the terms "right," "left," "forward," "rearward," "top," "bottom," and the like refer to directions relative to the conventional orientation of the figure. For example, the head is at the "forward" portion of the figure's body, and the tail is positioned at the "rearward" portion of the figure's body. The term "horizontal" means a plane generally parallel to the ground or other surface above which the hovering toy creature 99 is flying. The term "vertical" means the direction generally perpendicular to the ground or other surface above which the hovering toy creature 99 is flying. The term "electronic signal" means any wireless electromagnetic signal transmitted from a wireless control device 5 to the control system 15 (shown generically in FIG. 6) for controlling the hovering toy creature 99. In the most common embodiment, the electronic signal is a radio frequency signal typical for radio controlled (RC) toys.

Figure 1:
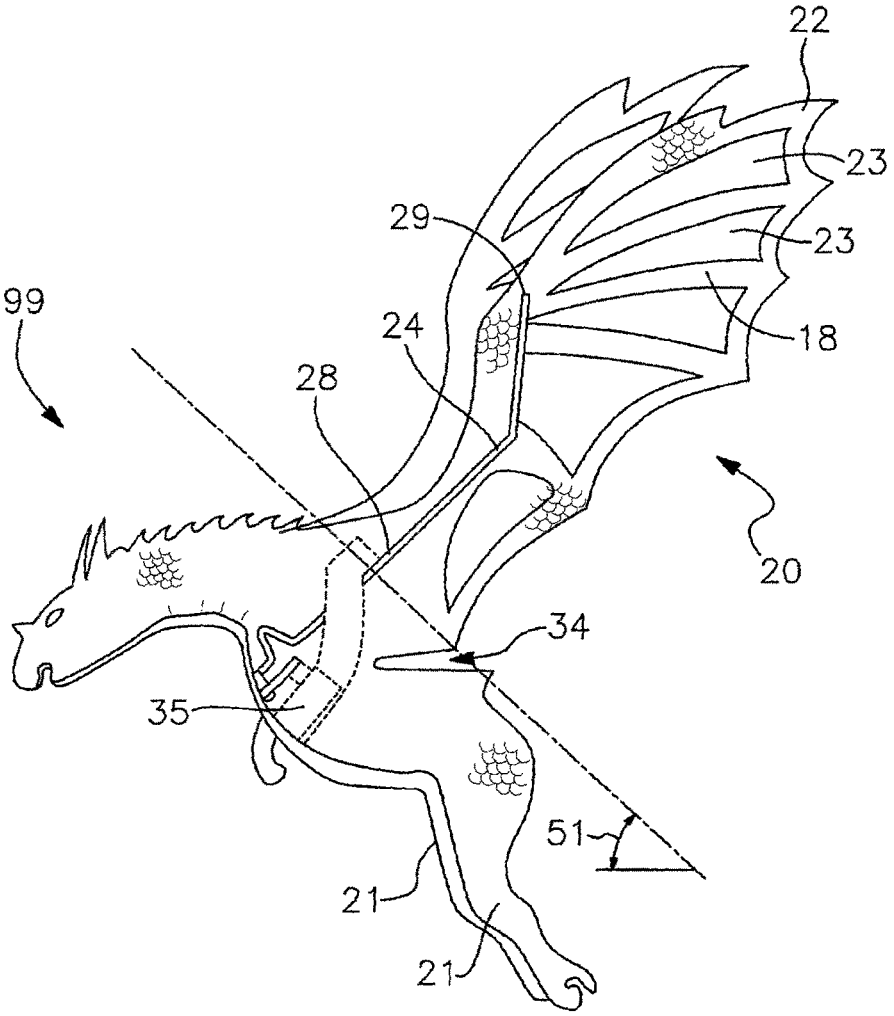
FIG. 1 is an elevation of one embodiment of the remote controlled hovering toy creature with the propulsion system removed and the left arm of the body removed, thereby showing a typical placement of the wing actuation assembly.
Figure 2:
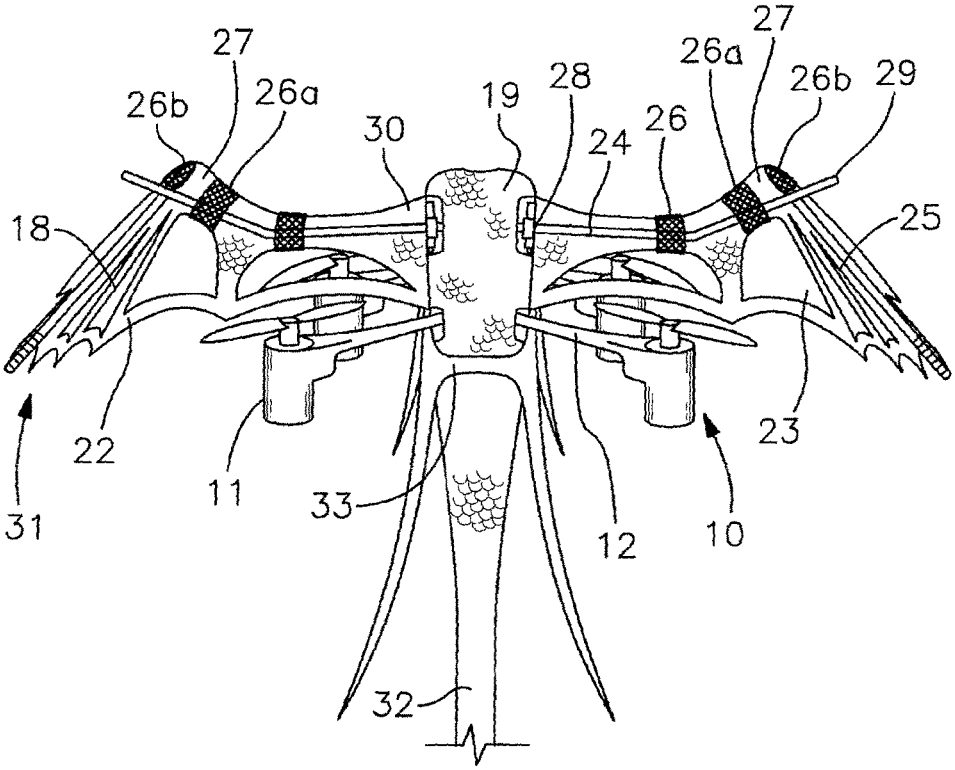
FIG. 2 is a rear view elevation of one embodiment of the remote controlled hovering toy creature during the upstroke of the wings.
Figure 3:
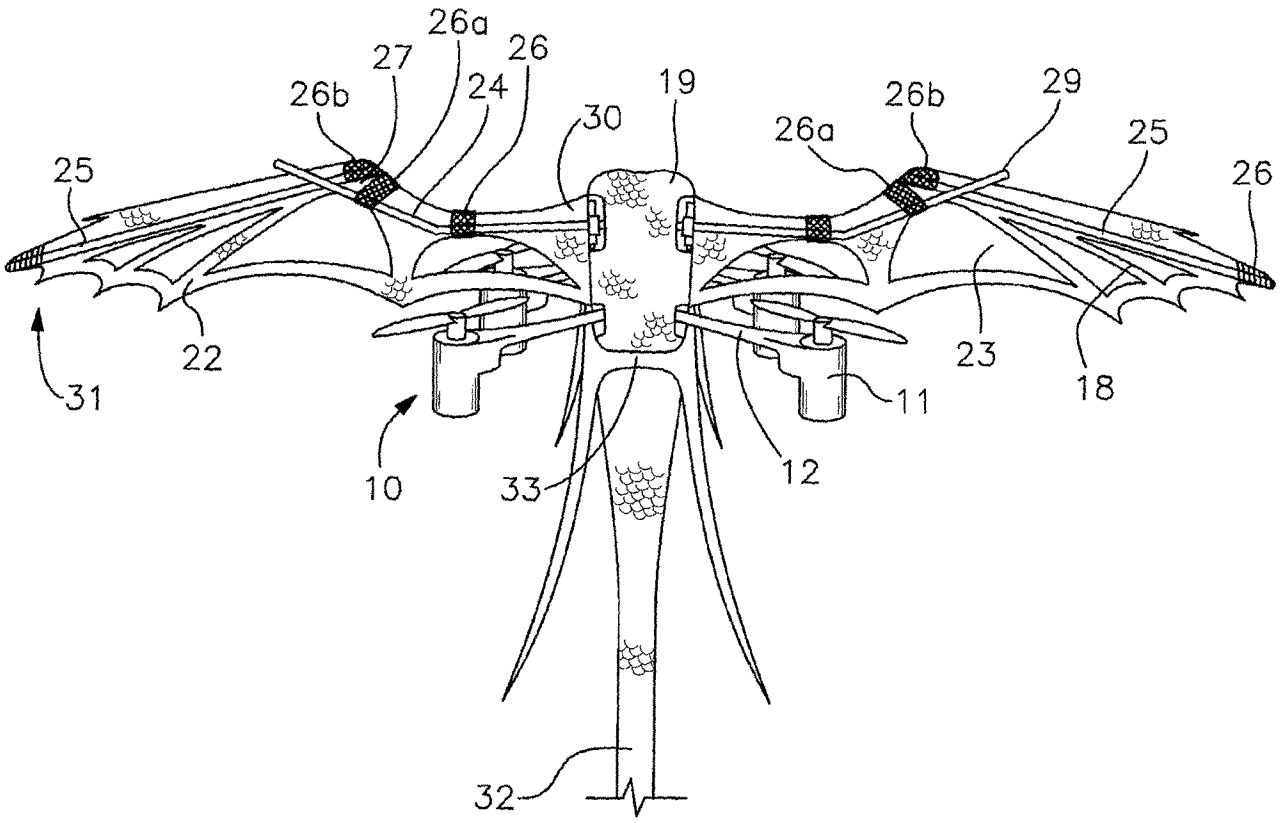
FIG. 3 is a rear view elevation of one embodiment of the remote controlled hovering toy creature during the down stroke of the wings.

Referring to FIGS. 1-3, the hovering toy creature 99 generally comprises a propulsion system 10, a control system 15, a winged body 20, and a wing actuation assembly 35. The winged body 20 is mounted to the propulsion system 10, which is controlled by the control system 15. The wing actuation assembly 35 can be mounted to either the propulsion system 10, the winged body 20, or both, and the winged actuation assembly 35 is powered by the control system 15, as discussed below.

In one embodiment, the propulsion system 10 comprises any one of a number of known propeller-driven lift units that comprises at least one propeller unit 11. For example, the propulsion system 10 comprises any one of a number of known quadcopters or hexacopters, which generally comprise four propeller units 11 or six propeller units 11, respectively, arranged in a substantially co-planar configuration. The propeller units 11 are oriented vertically to provide lift to the hovering creature 99. As an alternative, the propeller units 11 could be oriented substantially vertically, being angled or canted slightly towards the winged body 20. This configuration of the propeller units 11 creates a dihedral stabilizing effect on the overall hovering toy creature 99. In other words, canting the propeller units 11 toward the body 20 results in the propeller units 11 creating a thrust vector that has a horizontal component directed toward the body 20. The propeller units 11 are generally connected by a frame 12, which provides structural support and rigidity to the propulsion system 10. It will be appreciated that the components of such propulsion systems 10 include components such as propellers, electric remote controlled motors, gyroscopes, accelerometers, collision avoidance features, and the like.

The propulsion system 10 is controlled by a control system 15 (generically depicted in FIG. 6), which comprises all of the electrical components for operation of the remote controlled toy creature 99. The control system 15 typically comprises a wireless receiver for receiving wireless signals from a wireless control device 5 (shown in FIG. 7), a power source such as a battery, a circuit board, and other electronic components and wiring necessary to create electrical connectivity between the receiver, power source, and the motorized propeller units 11 of the propulsion system 10. The main components of the control system 15 are attached to either the propulsion system 10 or the winged body 20, or both. A removable attachment is preferable so that damaged components can be removed and replaced in the event of a destructive crash landing. However, a permanent attachment of the control system 15 and its components is sufficient.

The winged body 20 takes the form of the hovering toy creature 99, whether the form be that of a bird, a reptile, an insect (e.g. a butterfly), a mammal (e.g. a bat), or a mythical creature (e.g. a dragon). The winged body 20 generally comprises one or more side panels 21 or other housing or housing-like member, and two or more wings 22. In embodiments having two side panels 21, it is advantageous, but not necessary, for the winged body 20 to additionally comprise connectors, spacers, or lateral support members 33 between the side panels 21 such that the side panels 21 are held in a relatively fixed position with respect to each other. The side panels 21 or housing comprises a mount 34 for mounting the winged body 20 to the propulsion system 10. The mount 34 is configured such that the frame 12 of the propulsion system 10 snugly and removably mates with the mount 34. The propulsion system 10 and winged body 20 can be further secured together by connection members, such as glue, tape, clips, latches, clasps, or an equivalent member. The side panels 21 and wings 22 are constructed of thin, lightweight, flexible, and durable material. Many types of plastics, such as polyethylene materials, are suitable for this construction. Mylar is a non-limiting example of such material. Other examples include injection-molded plastic.

The wings 22 of the body 20 have a support 30 attached to the body 20, and a tip 31 extending away from the body 20. The wings 22 are configured either with or without apertures 23. The apertures 23 enable the passage of air through the wings 22. In effect, the apertures 23 remove surface area from the wings 22, thus reducing the aerodynamic forces generated by the wings 22 during the flapping motion. The apertures 23 are sized and oriented to produce the desired aerodynamic effect of the wings 22. In embodiments with no apertures 23, the flapping wings 22 create the largest aerodynamic forces for any given shape of wing 22. However, fitting the wings 22 with larger apertures 23 or a greater number of apertures 23 reduces the overall surface area of the wings 22, which then generate smaller aerodynamic forces during the flapping motion. Based on the surface area removed from the wings 22 by the apertures 23, the aerodynamic forces produced by the flapping wings 22 is proportioned to the lift and other aerodynamic forces produced by the propulsion system 10. That is, apertures 23 can be adjusted so that the wing-flapping forces are greater than or less than the typical forces produced by the propulsion system 10.

When apertures 23 are present in the wings 22, it is preferable to orient the apertures 23 in shapes that promote the overall appearance of the hovering toy creature 99. For example, when the creature 99 is in the shape of a dragon or a bat, the apertures 23 are shaped in a curved fanning orientation to simulate removal of portions of the dactylopatagium major, the dactylopatagium medius, the plagiopatagium, or any combination of these membranes in a manner that accentuates the fingers 18 of the wing 22. In embodiments where the hovering toy creature 99 takes the form of a butterfly, the apertures 23 could be in the shape of circles or ovals to simulate the markings on the butterfly wings.

The wings 22 comprise a first spine 24 to provide stiffness and form to the wing material. The spine 24 is selected from material that provides the optimum combination of strength, stiffness, and weight. For example, in most embodiments that have Mylar wings 22, the first spine 24 is a wire or thin rod of metal or plastic. The first spine 24 can be bent or contoured to conform to the shape of the wing 12. The first spine 24 runs along the wing 22, terminating at some point along the length of the wing 22. The termination point depends on the contour and shape of the wing 22. The first spine 24 is attached to the wing 22 by means for attaching the spine 24 to the wing 22, such attachment means 26 being glue, tape, ties, fasteners, clips, or the like.

The first spine 24 has a base 28 and a distal end 29, wherein the base 28 is operably connected to the wing actuation assembly 35 such that the first spine 24 extends along the wing 22, and the distal end 29 extends beyond the termination point of the connectivity between the first spine 24 and the wing 22, or a first spine connectivity termination point 26*a*. In some embodiments, the user may desire the wing 22 to resemble Chiropteran wings 22, such as the wings of a bat or a dragon. In these embodiments, it is preferable for the wing 22 to comprise a second spine 25, which simulates the second finger or third finger of the Chiropteran wing 22. The second spine 25 is attached to the wing 22 by an attachment means 26 in proximity to the second finger or third finger of the wing 22. The first and second spines 24, 25 are oriented on the wing 22 such that the spines 24, 25 cross tips in the proximity of the wrist of the wing 22, with the distal end 29 of the first spine 24 crossing above the tip of the second spine 25. See FIGS. 2 & 3. As shown in FIGS. 2 and 3, the first spine 24 and the second spine 25 are separated to form a flex zone 27 between the attachment means 26 of the respective spines 24, 25. That is, the second spine 25 is attached to the wing 22 at a second spine connectivity termination point 26*b* that is located between the first spine connectivity termination point 26*a* and the tip 31 of the wing 22 such that a space between the first spine connectivity termination point 26*a* and the second spine connectivity termination point 26*b* is a flex zone 27 in the wing 22. The second spine 25 is oriented such that the distal end 29 of the first spine 24 and a tip of the second spine 25 cross in proximity to the flex zone 27.

On the upstroke of the wing 22, the wing actuation assembly 35 lifts the first spine 24, as described below. As the first spine 24 is lifted, the wing 22 bends at the flex zone 27 such that the wing tip 31 droops as the wing 22 is raised, and the spines 24, 25 separate from contact with each other. At the top of the upstroke, the wing tip 31 snaps to an upright position due to its momentum, and the down stroke of the flapping cycle begins again. During the down stroke of the wing 22, the wing tip 31 straightens out, and the second spine 25 is placed into contact with the first spine 24 such that the first and second spines 24, 25 provide stiffness across the flex zone 27 along the full length of the wing 22. In this manner, when the wing 22 droops on the upstroke and straightens on the down stroke, the action of the wing 22 appears more realistic during flight of the toy creature 99.

In another embodiment of the wings 22, the attachment means 26 of the first spine 24 to the wing 22 permits the wing 22 to rotate about the spine 24 as the wing 22 proceeds through the flapping motion. This embodiment of the wings 22 is particularly useful when the angle 51 approaches 90-degrees so that the flapping motion is more horizontal than vertical. In this orientation, the wing 22 is rotatably adjusted about the first spine 24 during the forward stroke such that the wing 22 is oriented at about 45-degrees from horizontal, thus pushing air in a downward direction and creating lift during the forward stroke. Near the end of the forward stroke, the wing 22 rotates about 90-degrees around the first spine 24 such that on the backward stroke, the wing 22 is again oriented at about 45-degrees from horizontal, again pushing air in a downward direction and creating lift. Thus, the wings 22 generate lift during the forward and backward strokes of the flapping motion. In this embodiment, the attachment means comprises notches, tabs, stops, or other similar features to prevent over-rotation of the wing 22.

Optionally, the winged body 20 can comprise one or more access hatches 19 so that the user can access the internal components of the propulsion system 10, the control system 15, or the wing actuation assembly 35. The location, orientation, and configuration of such access hatches depends on the overall shape of the winged body 20 and the flying toy creature 99.

In some embodiments of the winged body 20, the body 20 comprises a tail 32. The tail 32 may or may not be a structural or aerodynamic feature of the toy creature 99. For example, the tail 32 could be maneuverable, such as with servos, to form an aerodynamic rudder at the rearward part of the toy creature 99. As another alternative, the tail 32 could be weighted to provide ballast to the hovering toy creature 99. Alternately, the tail 32 could be included merely for aesthetics, with no weights or movable features.

Figure 4:
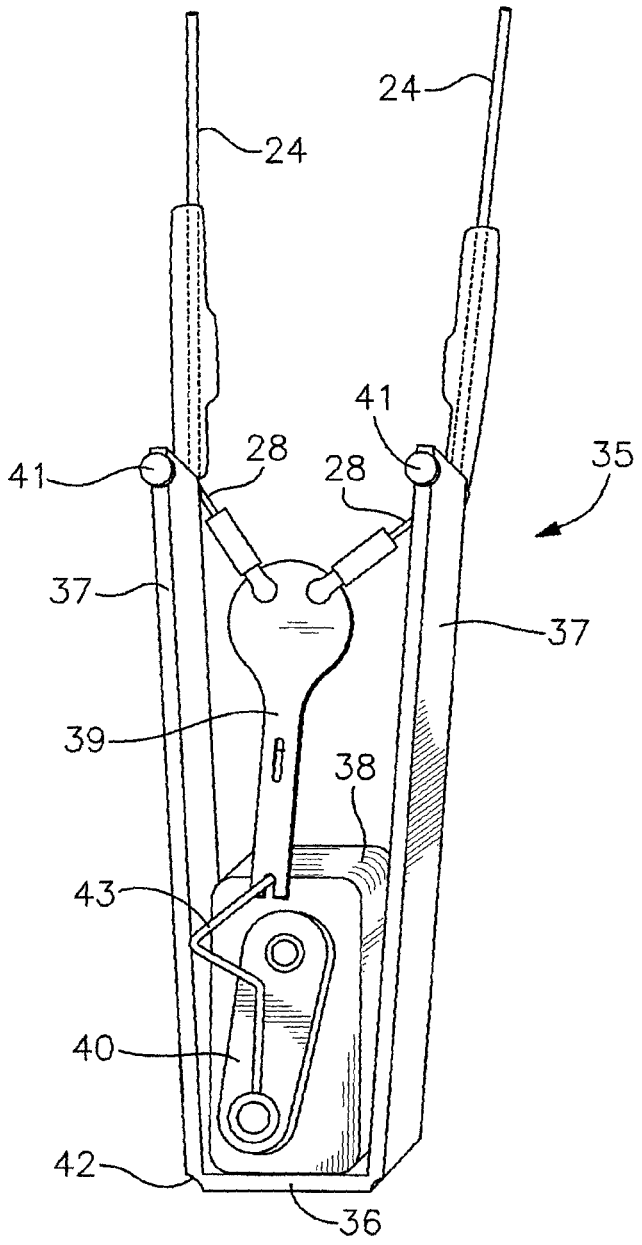
FIG. 4 is a perspective view of one embodiment of the wing actuation assembly at the top of the upstroke of the wings.
Figure 5:
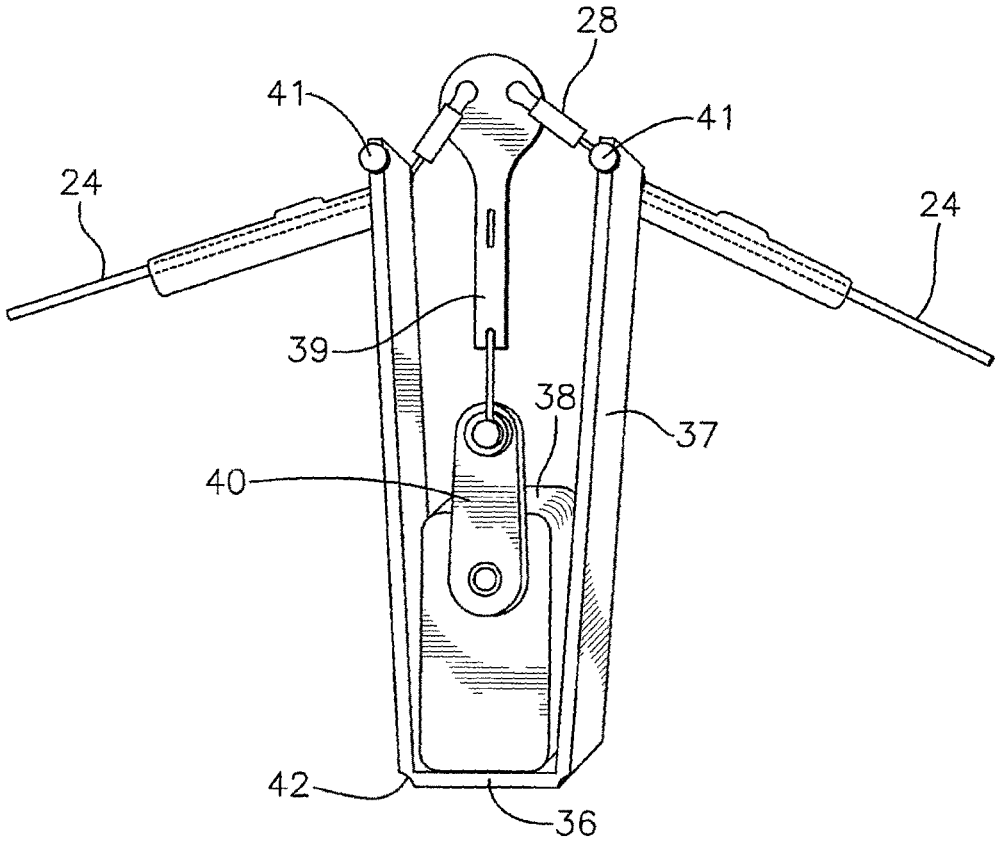
FIG. 5 is a perspective view of one embodiment of the wing actuation assembly at the bottom of the down stroke of the wings.
Figure 6:
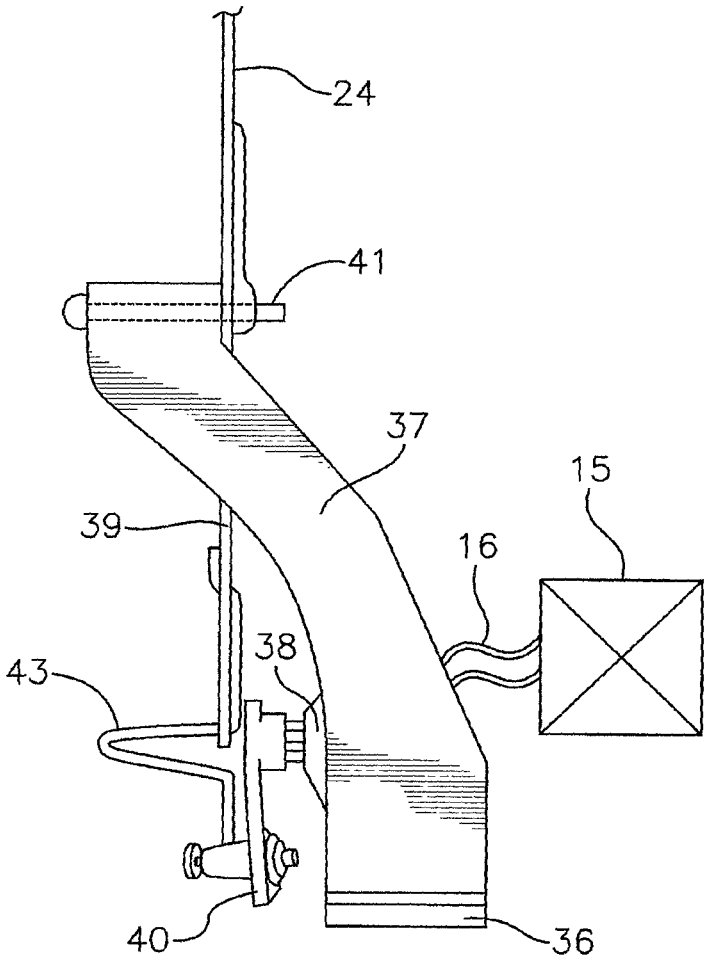
FIG. 6 is right side view of the wing actuation assembly, showing its connection to a generic control system.
Figure 7:
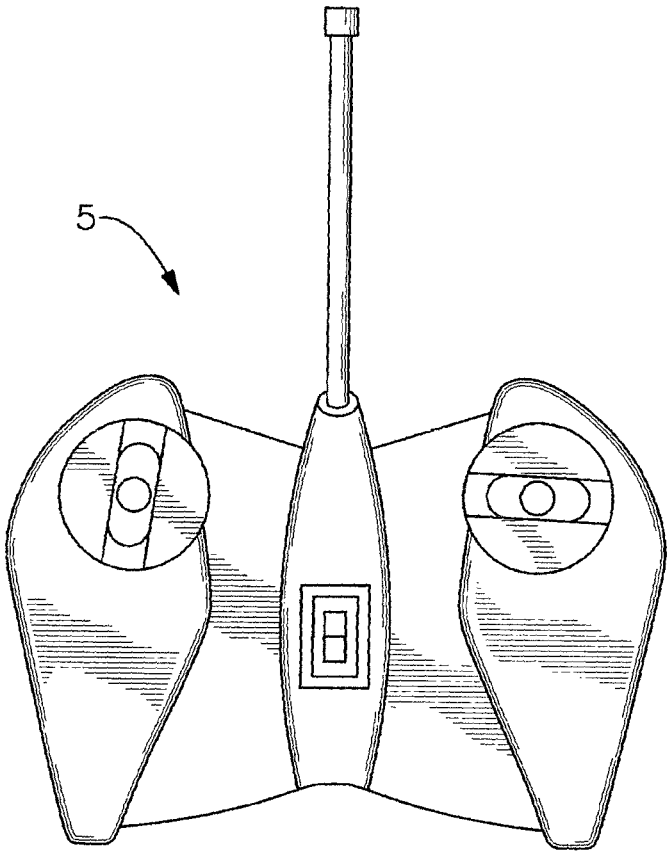
FIG. 7 is a top view of a typical wireless control device.

Referring to FIGS. 4-6, the wing actuation assembly 35 comprises the components necessary to actuate wing 22 movement in a flapping motion. For example, in one embodiment the wing actuation assembly 35 comprises a frame having a base 36, vertical struts 37, and a servo 38. The servo 38 has wires 16 connecting it to the control system 15 components, such as the battery. The servo 38 has a rotating arm 40, which is connected to a linking assembly 39. As the arm 40 rotates, the motion of the arm 40 drives the linking assembly 39 up and down in a cyclical manner. The linking assembly 39 is connected to the base 28 of the first spine 24, and each of the first spines 24 is attached to the adjacent strut 37 by an axle member 41. As the linking assembly 39 moves up and down in a cyclical oscillation, the linking assembly 39 articulates the base 28 in the same motion, causing the first spine 24 to rotate about the axle member 41. The resulting cyclical oscillation of the first spine 24 causes the wing 22 to move in a corresponding upstroke and down stroke motion, causing the flapping movement.

On one embodiment of the wing actuation assembly 35, the base 36 and struts 37 are integral members folded to form the necessary structural support for the wing actuation assembly 35. In this embodiment, and depending on the configuration of the winged body 20, as the arm 40 rotates the struts 37 are required to move apart to allow ample lateral clearance for the arm 40 in its horizontal position. Flexibility is promoted by a joint assembly 42 at the corners of the base 36/strut 37 connection point. For example, the joint assembly 42 could be notches 42 that create a thinner cross section of the base 36/strut 37 material, thereby promoting flexibility of the joint assembly 42 and accommodating lateral movement of the struts 37 relative to the servo 38 and the rotating arm 40. A hinge-type joint assembly 42 could accomplish the same purpose. The joint assemblies 42 provide additional degrees of freedom to the wing actuation assembly 35. That is, the combination of the axle members 41 at the top of the struts 37, and the joint assemblies 42 at the bottom of the struts 37 provide significant lateral flexibility to the wing actuation assembly 35, and therefore to the body 20. This flexibility enhances the durability of the hovering toy creature 99 under the impact forces caused by collisions and crash landings.

In many embodiments, the movement of the linking assembly 39 creates a jarring force on the first spines 24. Thus, one embodiment of the linking assembly 39 includes a spring member 43 that is configured to soften the jarring motion of the linking assembly, thereby softening the actuating effect on the first spines 24.

During flight, the lift and control of the hovering toy creature 99 is controlled and driven by the propulsion system 10. In other words, the aerodynamic forces produced by the wings 22 are not the main forces lifting and maneuvering the hovering toy creature 99. However, as the wings 22 flap, they produce an uplift force on the hovering toy creature 99. Thus, during flight the flapping wings 22 cause a "bouncing" effect, making the hovering toy creature 99 appear to be life-like during flight. The bouncing effect becomes more pronounced when there are no wing apertures 23, or when such apertures 23 are relatively small. The bouncing effect is minimized, or even eliminated, when the area of the apertures 13 approaches that of the overall wing 12 surface. In most embodiments, a pleasant bouncing flight is produced when the apertures 23 are in the range of about 60 percent to about 80 percent of the wing 12 surface.

In one embodiment, the wings 22 flap in a substantially vertical direction that is perpendicular or near perpendicular to the ground. However, to further enhance the life-like appearance of the hovering toy creature 99, in another embodiment the wings 22 pivot about an axis that is inclined at an angle 51 of about 45-degrees from horizontal. See FIG. 1. An orientation angle 51 that varies from about 5-degrees to about 75-degrees will produce similarly pleasing results. Depending on the embodiment, angles in the range of about 75-degrees to about 85-degrees produce a bouncing effect that appears more accurate for the particular embodiment, such as for fanciful winged creatures. As an added benefit, a steeper angle 51 also enables a more horizontal orientation to the flapping motion of the wings 22, thereby providing greater clearance between the wings 22 and the first rotor 56 and second rotor 59 discussed below. In one embodiment, the angle 51 is approximately 90-degrees, producing a flapping motion with a forward stroke and a backward stroke rather than a down stroke and an upstroke.

The orientation and location of the control system 15 components can be adjusted with respect to the propulsion system 10 and winged body 20 so that the creature 99 remains balanced during flight. In other words, the components of the control system 15 can be placed within the body 20 to adjust the center of gravity of the overall hovering toy creature 99. For example, the battery, one of the heavier components of the hovering toy creature 99, can be placed in proximity to rearward position within the creature 99, especially in embodiments when the wing actuation assembly 35 is placed in proximity to a forward position within the creature 99. The control system 15 can also be oriented to serve as a ballast to counter balance the momentum of the flapping wings 22. The precise orientation of the control system 15 components will depend on the overall shape and configuration of the hovering toy creature 99. Likewise, the struts 37 of the wing actuation assembly 35 can be curved or shaped so that the center of gravity of the wing actuation assembly 35 can be adjusted with respect to the other components of the flying toy creature 99. See FIGS. 1 & 6.

In one specific embodiment of the hovering toy creature 99, the wing actuation assembly 35 comprises 2 mm thick corrugated plastic configured in a "U-shape" with the servo 38 mounted centrally. The struts 37 are the arms of the U, and the base 36 is the bottom of the trough. The servo 38 is a CSRC-35, 3-gram servo with the gears modified to spin continuously, and the other electronics other than the motor are removed. The battery is a 3.7 volt, 300 mAh, 20*c* battery that is common in the RC toy industry. The winged body 20 is made of 0.006-inch (0.15 mm) thick Mylar sheet. The quadcopter used for the propulsion system 10 is a WL Toys QR series Ladybird V939 with a 3-axis gyroscope unit for stabilization. As another alternative, the propulsion system 10 could be a UdiRC U816A 2.4G with a 6-axis gyroscope for improved stability. Both of these propulsion systems 10 poly-copters have a 2.4 Ghz, four-channel radio system.

In another embodiment, the propulsion system 10 can be removed, as shown in FIG. 1. In this embodiment, the toy creature 99 is not a hovering device. Instead, without the propulsion system 10, the toy creature 99 is a handheld toy with flapping wings 22. In this embodiment, the control system 15 (shown in FIG. 6) primarily comprises a battery to power the wing actuation assembly 35, which remains as described above. In this handheld toy embodiment, the control system 15 can be configured with or without a receiver for receiving a wireless signal, depending on whether a wireless control device 5 is used to control the action of the wings 22.

In one embodiment, the wings 22 and the wing actuation assembly 35 are contained in a single wing assembly unit, without a propulsion system 10, and without a body 20. Examples of this self-contained wing assembly unit are represented in FIGS. 4-6. In this embodiment, the wing assembly unit is configured for attachment to other action figures as desired. For example, the wing assembly unit could be fitted to an action figure that takes the form of a wingless male human. Attaching the wing assembly unit to such an action figure creates a Batman-like appearance to the action figure. In this manner, the user can create many different permutations of winged toy creatures by combining the wing assembly unit with pre-existing action figures, as desired.

Figure 8:
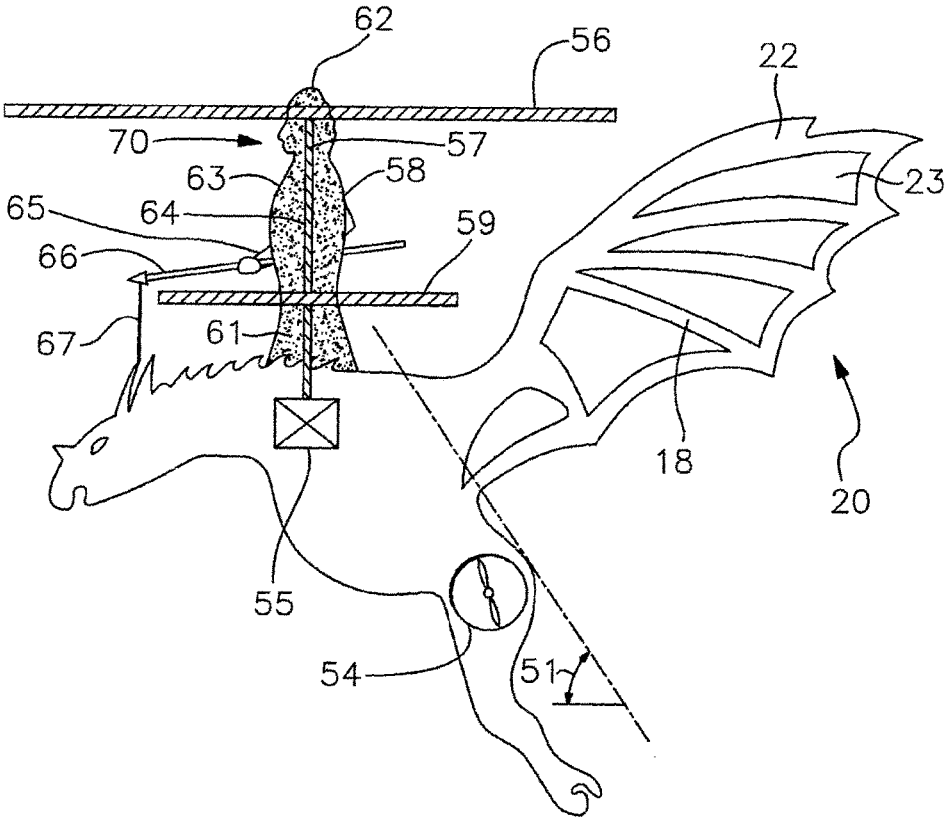
FIG. 8 is a cross section of one embodiment of the hovering toy creature having a riding figure, without the wing actuation assembly shown.

In another embodiment, shown in FIG. 8, the quadcopter or hexacopter units of the propulsion system 10 are removed and replaced with one or more rotors in a coaxial arrangement. For example, in this embodiment the propulsion system 10 comprises a motor drive 55 driving a first rotor 56 via a rotor mast 57, which is supported by a housing 58. A second rotor 59 is operatively engaged by the motor drive 55. The motor drive 55 comprises one or more motors for operating the first rotor 56, second rotor 59, and any other rotors, as will be appreciated by a skilled practitioner. Additional rotors or stability bars can be added to the rotor mast 57 as needed or desired. The first rotor 56 and the second rotor 59 can be configured to spin in the same direction or in opposite directions.

When the first rotor 56 and the second rotor 59 spin in opposite directions, there is no need for a stabilizer rotor 54. However, if the propulsion system 10 comprises only a first rotor 56 with no second rotor 59, or if the first rotor 56 and the second rotor 59 spin in the same direction, then a stabilizer rotor 54 is needed for angular stability of the creature 99. Alternately, the stabilizer rotor 54 could be located at the front of the hovering toy creature 99, such as in the nose or neck area of the toy creature 99 (not shown). There are a variety of arrangements of the first rotor 56, the second rotor 59, additional rotors, stability bars, stabilizer rotors 54, and motor drives 55 that are suitable for operation of the hovering toy creature 99, as will be appreciated by a skilled practitioner. In each of the foregoing embodiments, the motor drive 55 is operatively connected to and controlled by the control system 15.

The housing 58 provides lateral bracing to the rotor mast 57, which typically is a slender vertical member. The housing 58 aids in preventing buckling, wobbling, or other lateral vibration of the rotor mast 57 during operation. The housing 58 comprises an opening 64, such as a hollow cylindrical shaft, sized to snugly receive the rotor mast 57 in a manner permitting the rotor mast 57 to spin relatively friction free.

In one embodiment, the housing 58 is configured in the shape of a rider 70, which is a riding figure on the hovering toy creature 99. In an embodiment of the propulsion system 10 comprising only a first rotor 56, the housing 58 comprises a lower segment 61 located below the first rotor 56 and an upper segment 62 located above the first rotor 56. The lower segment 61 is attached to the winged body 20 such that the orientation of the lower segment 61 is fixed in relation to the winged body 20. The shape of the lower segment 61 depends on the placement of the first rotor 56. For example, if the first rotor 56 is located at or near the location of the waist of the rider 70, then the lower segment 61 takes the shape of legs attached to the winged body 20. If the first rotor 56 is attached above the shoulder area of the rider 70, then the lower segment 61 takes the shape of the torso and legs of the rider 70. In each embodiment, the upper segment 62 is attached to the rotor mast 57 and spins with the first rotor 56, with the lower segment 61 being attached to the winged body 20 and remaining fixed with respect to the winged body 20 as the rotor mast 57 spins inside the opening 64, which is a hollow cylindrical shaft 64 of the lower segment 61.

In an embodiment with a first rotor 56 and a second rotor 59, the housing 58 further comprises a middle segment 63 located between the first rotor 56 and the second rotor 59. The middle segment 63 is configured in the shape of the torso of the rider 70. The middle segment 63 comprises an arm 65 of the rider 70 that holds a spear 66. A retaining member 67 connects the spear 66 to the winged body 20, such as a horn on the head of the winged body 20. In this manner, the retaining member 67 prevents the middle segment 63 from spinning as the rotor mast 57 spins inside the hollow cylindrical shaft 64 of the middle segment 63. The lower segment 61, which remains securely attached to the winged body 20, takes the form of the legs of the riding figure, and the upper segment 62 is as described above. The retaining member 67 is a wire, rod, strap, or other member configured to retain the middle segment 63 from spinning with the rotor mast 57.

In any of the embodiments comprising a first rotor 56 or a second rotor 59, one embodiment of the wing actuation assembly 35 is as described above. However, the angle 51 is increased to the range of about 50 to about 80 degrees, thereby orienting the wings 22 in a more horizontal flapping direction and emphasizing the horizontal component of flapping motion. In one embodiment, the angle 51 is about 70 degrees. One of the advantages of this increased angle 51 is to promote flapping of the wings 22 in a manner that does not interfere with operation of the first rotor 56 or the second rotor 59. Depending on the configuration of the wings 22, the increased angle 51 alters the bouncing effect of the flight by creating a more pronounced horizontal component to the aerodynamic force produced by the flapping wings 22.

Figure 9:
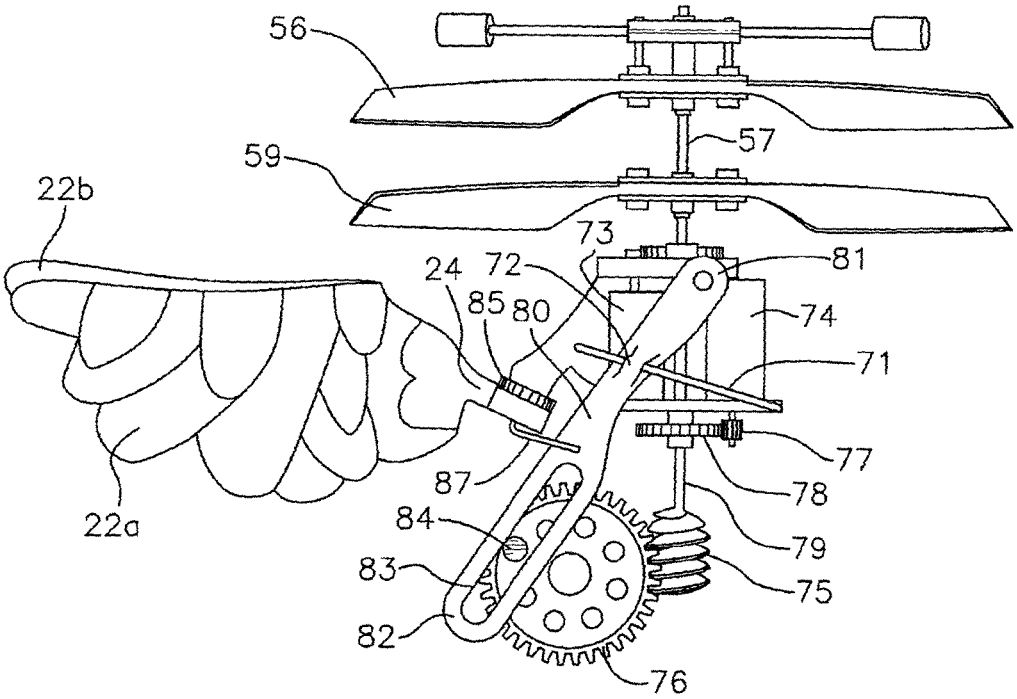
FIG. 9 is a side view of one embodiment of the propulsion system and the wing actuation assembly placed in operative engagement by a worm device and a worm wheel.
Figure 10:
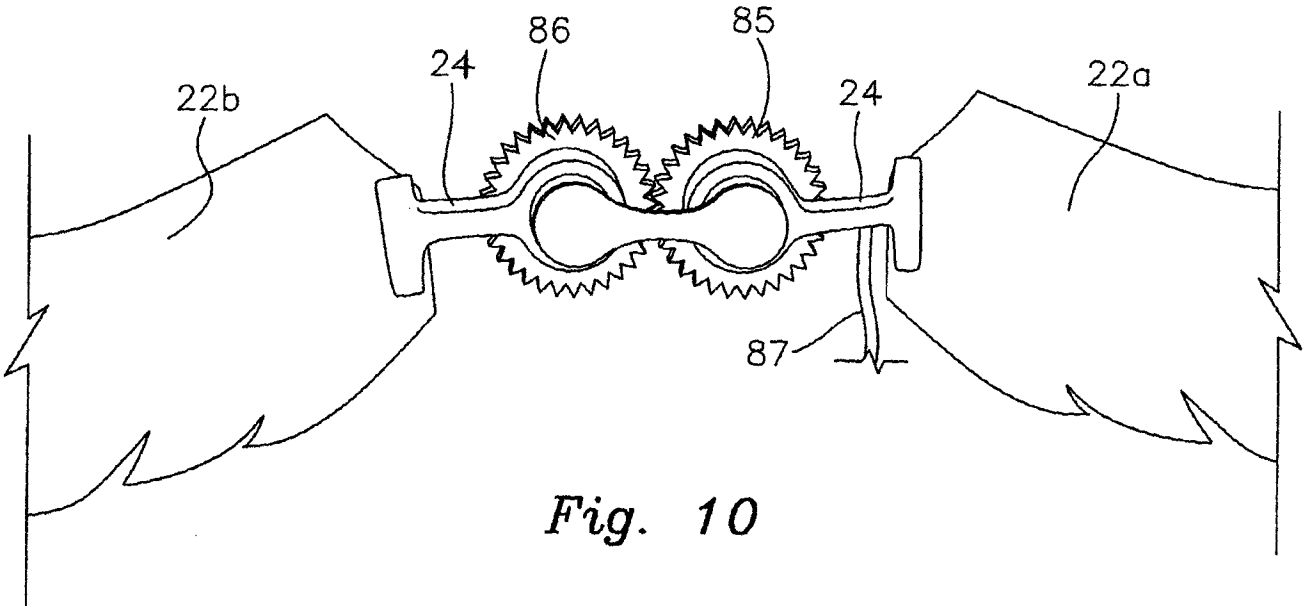
FIG. 10 shows one embodiment of the wing gears of the wing actuation assembly.

To save weight of the hovering toy creature 99, one embodiment uses a total of only two motors to drive the propulsion system 10 and the wing flapping motion. In this embodiment, shown in FIGS. 9-10, the propulsion system comprises a motor drive 55 having a first motor unit 73 for driving a first rotor 56, a second motor unit 74 for driving a second rotor 59, and a first drive device 75 placed in operable communication with a second drive device 76, which is part of the wing actuation assembly 35. The second drive device 76 drives the wing-flapping motion, and there is no need for a third motor unit to separately actuate the wings 22 in a flapping motion. In alternate embodiments, the first drive device 75 and the second drive device are, respectively: (i) a worm device and a worm wheel; (ii) a first beveled gear and a second beveled gear; (iii) a first helical gear and a second helical gear, the first and second helical gears having crossed gear mesh; or (iv) some other combination of these gear arrangements or other gears. In each of these embodiments, the first drive device 75 is configured to engage the second drive device 76 in a mating arrangement. In the embodiments described below, the first and second drive devices 75, 76 could embody any combination of these examples of gear devices. For the sake of clarity and not limitation, however, the following embodiments are discussed in the context of a worm device 75 and a worm wheel 76.

In this embodiment, a pinion 77 placed in operable communication with a drive gear 78. The pinion 77 is operatively engaged to either the first motor unit 73 or the second motor unit 74 of the motor drive 55. In one embodiment, a drive shaft 79 links the drive gear 78 with a worm device 75. For example, in one embodiment, the first motor unit 73 comprises the pinion 77, which is placed in engagement with the drive gear 78, which turns the worm device 75 via the drive shaft 79. In an alternate embodiment, the rotor mast 57 can be combined with the drive shaft 79. The rotor mast 57 is extended below the location of the first and second motor units 73, 74, and the worm device 75 is attached to the bottom of the rotor mast 57. The drive gear 78 is attached to the rotor mast 57 at a location above the location of the worm device 75.

In this embodiment of the wing actuation assembly 35, the assembly 35 has a slotted lever 80 having a rotation point 81 and a free end 82, the slotted lever 80 having an elongated slot 83 configured to receive a crank pin 84 attached to the worm wheel 76. This embodiment of the wing actuation assembly 35 further comprises a first wing gear 85 disposed in operable communication with a first wing 22*a* and a second wing gear 86, the second wing gear 86 disposed in operable communication with a second wing 22*b*. The first and second wing gears 85, 86 are securely connected to the first and second wings 22*a*, 22*b*, respectively, by first spines 24. A reciprocating member 87 connects the slotted lever 80 to either the first spines 24. In exemplary embodiments, the reciprocating member 87 could be a rod, pin, connection member, linking member, or the like that connects at one end to the slotted lever 80 and at the other end to the first spine 24.

In the operation of one embodiment, the first motor unit 73 primarily drives the first rotor 56. The second motor unit 74 has a motor shaft that is connected to the pinion 77, and the pinion 77 is placed in operable communication with the drive gear 78. The motor shaft of the second motor unit 74 turns the pinion 77 in a continuous motion so that the pinion 77 turns in one direction, thereby driving the drive gear 78 to turn continuously in the opposite direction. The drive shaft 79 and the worm device 75 therefore turn continuously in the same direction as the rotation of the drive gear 78. The worm device 75 is in operative communication with the worm wheel 76, therefore causing the worm wheel 76 to turn in a continuous motion. The crank pin 84, which is attached to the side of the worm wheel 76, moves in a circular motion with the worm wheel 76, thereby causing the slotted lever 80 to be rotated about the rotation end 81 in an oscillatory manner.

The oscillatory motion of the slotted lever 80 drives a corresponding oscillatory motion of the first spine 24 via the reciprocating member 87, and the first spine 24 causes a corresponding oscillatory motion of the first wing 22*a* and the first wing gear 85. Since the first and second wing gears 85, 86 are in operative communication with each other, the oscillatory motion of the first wing gear 85 causes a corresponding oscillatory motion of the second wing gear 86 and its corresponding first spine 24, and the second wing 22*b*. Thus, in this embodiment, the rotation of the first and second rotors 56, 59 and the flapping motion of the first and second wings 22*a*, 22*b* are driven by a total of two motor units, the first and second motor units 73, 74.

In one embodiment, the movement of the slotted lever 80 is constrained by a guide rod 71 and slider 72. The guide rod 71 is attached at one end to the body 20, the motor drive 55 or some other portion of the hovering toy creature 99, and the opposite end of the guide rod 71 is unsupported. The slotted lever 80 comprises a slider 72 configured to slidably receive the guide rod 71 during the oscillatory motion of the slotted lever 80. As the slotted lever 80 moves back and forth to create the flapping motion of the wings 22, the slider 72 slides back and forth along the guide rod 71 to provide a lateral constraint to the motion of the slotted lever 80. The slider 72 is a hole, loop, slot, or other mechanism or feature connected to the slotted lever 80 and slidably receiving the guide rod 71.

The frequency of the flapping wings 22 is determined by the gear ratio between the worm device 75 and the worm wheel 76. The first and second rotors 56, 59 must rotate at a rate high enough to provide lift to the hovering toy creature 99. However, in most embodiments it is desirable for the wings 22 to flap at a relatively low rate. Thus, the gear ratio between the worm device 75 and the worm wheel 76 is adjusted accordingly. In most applications, the gear ratio is in the range of about 25:1 to about 35:1.

In any of the forgoing embodiments of the control system 15, the control system 15 can be altered such that it is not controlled by a wireless control device 5. Instead, the control system 15 comprises a timer device 88 for controlling the propulsion system 10. This embodiment comprises no wireless control device 5. The control system 15 is modified to incorporate the timer device 88. The timer device 88 is configured to operate the propulsion system 10 by controlling either the propeller units 11 or the motor drive 55, as applicable.

Figure 11:
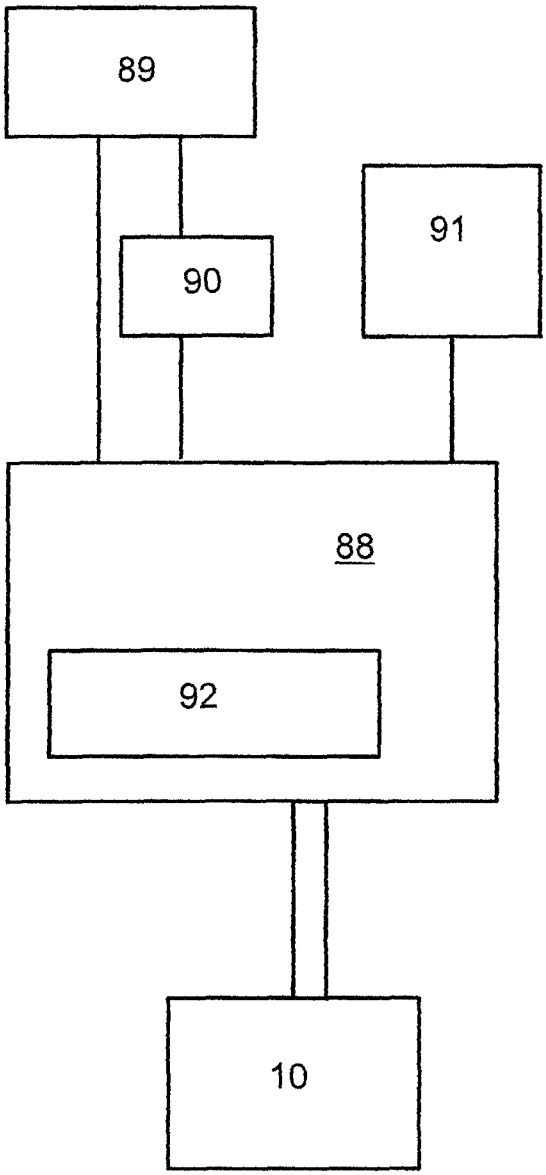
FIG. 11 is a diagram showing one embodiment of the connectivity between a power source, a timer device, and the propulsion system.

Referring to FIG. 11, the timer device 88 is an electrical component that enables power to transfer from a power source 89 to the propulsion units 11 or the motor drive 55 of the propulsion system 10. In this manner, the timer device 88 is configured to activate the propulsion system 10 upon the user's command, and then deactivate the propulsion system 10 after a predetermined period of time. For example, in many embodiments, the power source 89 is a battery that is part of the control system 15, and the power is electrical power flowing from the battery to either the propulsion units 11 or the motor drive 55 of the propulsion system 10, as applicable. Upon the user's command, the timer device 88 activates the battery 89 to power the propulsion units 11 or the motor drive 55, thereby activating the propulsion system 10, and then deactivate the battery 89 connectivity after a predetermined period of time, such as ten seconds, which deactivates the propulsion units 11 or motor drive 55, and therefore deactivates the propulsion system 10.

In these embodiments, the user activates the timer device 88 to start the propulsion system 10. The hovering toy creature 99 then takes to flight after a gradual ramping up of the propulsion system 10. After the predetermined period of time expires, the propulsion system 10 ceases operation, and the hovering toy creature 99 glides softly to the ground to make a landing. The timer device 88 can be configured to abruptly terminate the flow of electricity to the propulsion system 10, or the timer device 88 could be configured to gradually reduce the flow of electricity to the propulsion system 10 so that the propulsion units 11 or the motor drive 55, as applicable, are gradually powered down. Since this embodiment does not comprise a wireless control device 5, the user has no control over the hovering toy creature 99 during flight.

There are several embodiments of user activation of the timer device 88. For example, in one embodiment the timer device 88 is attached to the body 20 of the hovering toy creature 99. The control system 15 comprises an activation device 90 for activating the timer device 88. The activation device 90 is a switch, a button, a lever, or other device disposed in communication with the timer device 88 and configured for activating the timer device 88. In another embodiment, the hovering toy creature 99 comprises a resilient material, such as deformable plastic or rubber, and the activation device 90 is placed below the surface of the hovering toy creature 99. The user engages the activation device 90 by depressing the resilient material, thereby engaging the activation device 90. For example, the activation device 90 could be a button placed below a rubber surface on the hovering toy creature 99. The user engages the activation device 90 by depressing the rubber surface, which starts the timer device 88 and activates the propulsion system 10. The toy hovering toy creature 99 is then ready to take flight.

In one embodiment, the predetermined time periods of timer device 88 activation are adjustable by the user. The predetermined time periods could be five seconds, ten seconds, fifteen seconds, or some other time interval. The predetermined time period could be fixed by the timer device 88, or it could be selected by the user via a selector device 91. The selector device 91 is a switch, button, lever, or other device enabling the user to alter the predetermined time period for the timer device 88. For example, the selector device 91 could be a switch having two different positions corresponding to time periods of ten seconds and fifteen seconds, respectively, or other predetermined time intervals. The selector device 91 could have a third position or more, corresponding to time periods of twenty seconds, twenty-five seconds, or some other time interval. In another embodiment, the selector device 91 is a button that the user depresses once for a five second time period, twice for a ten second time period, three times for a fifteen second time period, and so on. In another embodiment, the selector device 91 is a button, and the user controls the predetermined time period by depressing the button and holding it down. For example, depressing the button for one second, two seconds, and three seconds corresponds to predetermined time periods of five seconds, ten seconds, and fifteen seconds, respectively, or other incrementally increasing or decreasing time periods.

In another embodiment, the selector device 91 is combined with the activation device 90 such that the control system 15 comprises three buttons. Depressing a first button 90*a*, 91 *a* (shown in FIG. 14) activates the propulsion system 10 for three seconds, depressing a second button 90*b*, 91*b* activates the propulsion system 10 for six seconds, and depressing a third button 90*c*, 91 *c* activates the propulsion system 10 for twelve seconds. In another exemplary embodiment, a first button 90*a*, 91 *a* is depressed to activate the propulsion system 10 for a first predetermined time period, such as a two second indoor flight time for use inside a building or a residential dwelling. A second button 90*b*, 91*b* is depressed to activate the propulsion system 10 for a second predetermined time period, such as a ten second outdoor flight time for use in the outdoors or in a large indoor area. The foregoing examples are for illustration only and are not intended to limit the scope of the scope of the selector device 91 or the timer device 88.

Referring again to FIG. 11, one embodiment, the timer device 88 further comprises a control unit 92, which comprises electronic circuitry or other functionality configured to control the flight pattern of the hovering toy creature 99 such that the hovering toy creature 99 flies in a predetermined flight pattern. The control unit 92 is a circuit, a microprocessor, controller, or another electrical or processing unit configured to control the propulsion system 10. The predetermined flight pattern could be a figure-eight, a circle, a serpentine pattern, or some other pattern.

In one embodiment, the control unit 92 is configured to control power delivered to each propulsion unit 11, motor unit 56, 59, or stabilizer rotor 54 to control the predetermined flight pattern. The variable power allocation controls the thrust output of each unit of the propulsion system 10.

The timer device 88 and the control unit 92 could be separate components or integrated into the same component within the control system 15. For example, the timer device 88 could be an electrical gate that permits electricity to flow from a power source 89, such as a battery, to the electrical propulsion system 10. The gate opens to enable operation of the propulsion system 10, and the gate closes to cut off the flow of electricity to the propulsion system 10, thereby terminating its operation.

Figure 12:
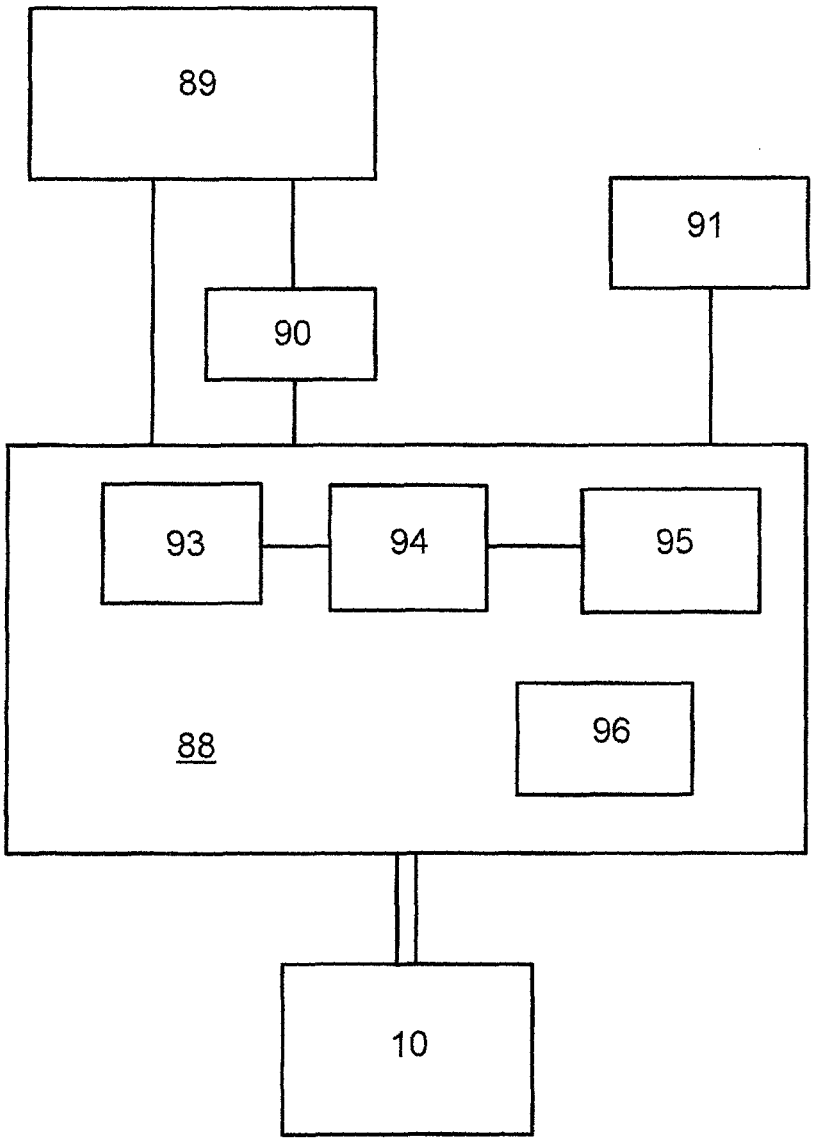
FIG. 12 is a diagram showing one embodiment of the connectivity between a power source, a timer device, and the propulsion system.

For example, in one embodiment, shown in FIG. 12, the timer device 88 comprises a board supporting circuitry for the electrical components described herein. The timer device 88 comprises a transistor 93, such as a metal-oxide-semiconductor field-effect transistor ("MOSFET"), and a capacitor 94. Transistors 93 other than a MOSFET could be suitable for the purpose as well. The activation device 90 signals the MOSFET 93 to open the gate, thereby permitting electricity to reach the capacitor 94 and fill it. After the activation device 90 is released, the capacitor 94 provides enough electricity to keep the gate open, thereby enabling the flow of electricity from the power source 89 to the propulsion system 10. Once the capacitor 94 has exhausted its electricity storage, the gate closes, electricity ceases flowing to the propulsion system 10, and the propulsion system 10 cease operation. The hovering toy creature 99 then glides or floats downward to a landing as described above.

In one embodiment, the timer device 88 further comprises a resistor 95, which slows down the discharge of electricity from the capacitor 94. The gate in the MOSFET 93 therefore stays open for a longer period of time, enabling operation of the propulsion system 10 for a longer time period. A resistor 95 providing greater resistance prolongs energy dissipation from the capacitor 94, thereby enabling a longer operational time of the propulsion system 10. Correspondingly, a resistor 95 providing lower resistance will comparatively lessen the operational time of the propulsion system 10. The timer device 88 can further comprise an optional circuit overload diode 96.

Figure 13:
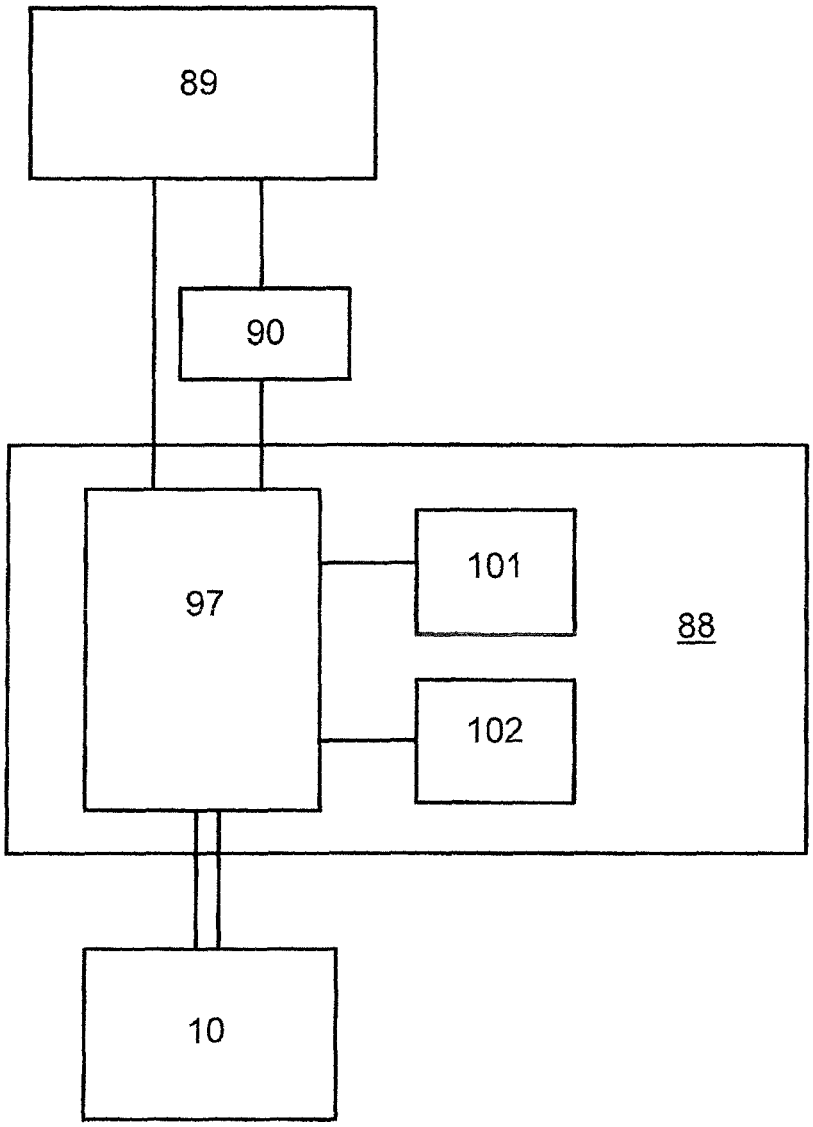
FIG. 13 is a diagram showing one embodiment of the connectivity between a power source, a timer device, and the propulsion system.

In another embodiment, shown in FIG. 13, the timer device 88 comprises an integrated circuit 97 pre-programmed with timing functionality, and two potentiometers ("pots"), a first pot 101 and a second pot 102. The integrated circuit 97 is programmed to read the values from the two pots 101, 102. The signals from the first and second pots 101, 102 are converted to a time values and thrust values, respectively. The activation device 90 signals the integrated circuit 97 to turn on the propulsion system 10 for the predetermined period of time designated by the signal from the first pot 101 at the thrust level determined by the signal from the second pot 102. Then the predetermined period of time expires, the integrated circuit 97 signals the propulsion system 10 to cease operation, and the hovering toy creature 99 descends to a landing.

Figure 14:
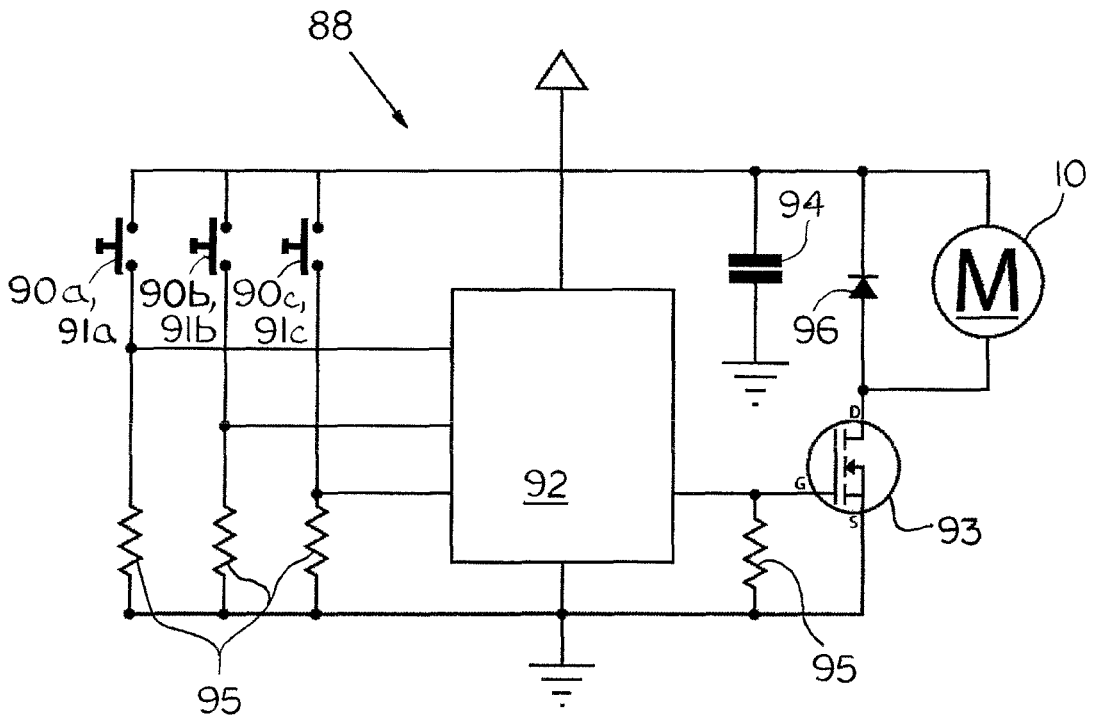
FIG. 14 is a diagram showing one embodiment of the connectivity between a power source, a timer device, and the propulsion system.

An alternate embodiment of the timer device 88 and control system 15 is shown in FIG. 14. In this embodiment, three activation devices 90*a*, 90*b*, 90*c* are combined with three selector devices 91*a*, 91*b*, 91*c*. The control unit 92 is configured or programmed such that depressing the first activation/selector device 90*a*, 91 *a* activates the propulsion system 10 for a first predetermined time period, depressing the second activation/selector device 90*b*, 91*b* activates the propulsion system 10 for a second predetermined time period, and depressing the third activation/selector device 90*c*, 91*c* activates the propulsion system 10 for a third predetermined time period. In this embodiment, the timer device 88 and control system 15 further comprise a transistor 93, capacitor 94, one or more resistors 95, and a diode 96 as shown in FIG. 14. Configurations of these components other than the configuration shown in FIG. 14 could also be suitable for controlling the hovering toy creature 99 flight for predetermined time periods, as will be appreciated by an ordinary practitioner.

The foregoing embodiments are merely representative of the hovering toy creature and not meant for limitation of the invention. For example, one having ordinary skill in the art would appreciate that there are several embodiments and configurations of wing members, propulsion systems, or wing actuation assemblies that will not substantially alter the nature of the hovering toy creature. Consequently, it is understood that equivalents and substitutions for certain elements and components set forth above are part of the invention described herein, and the true scope of the invention is set forth in the claims below.

What is claimed is:

1. A combined propulsion system and wing actuation assembly for a hovering toy creature, the combined system comprising:

a motor drive having a first motor unit for driving a first rotor, a second motor unit for driving a second rotor;

a first drive device; and a second drive device placed in operable communication with the first drive device, said second drive device configured to actuate two or more wings, thereby simulating a flapping motion.

2. The system of claim 1, further comprising a pinion in operable communication with the motor drive and a drive gear, the drive gear disposed in operable communication with the first drive device.

3. The system of claim 1, further comprising a slotted lever having a rotation point and a free end, the free end having an elongated slot configured to receive a crank pin attached to the second drive device.

4. The system of claim 1, further comprising a first wing gear disposed in operable communication with a first wing and a second wing gear, the second wing gear disposed in operable communication with a second wing.

5. The system of claim 1, further comprising:

a slotted lever having a rotation point and a free end, the free end having an elongated slot configured to receive a crank pin attached to the second drive device; and a first wing gear disposed in operable communication with a first wing and a second wing gear, the second wing gear disposed in operable communication with a second wing;

wherein the slotted lever is disposed in operable communication with the first wing such that angular motion of the slotted lever drives the first wing in a flapping motion, thereby actuating the first wing gear, the second wing gear, and second wing such that the first wing and second wing flap in a corresponding motion.

6. The system of claim 2, further comprising a slotted lever having a rotation point and a free end, the free end having an elongated slot configured to receive a crank pin attached to the second drive device.

7. The system of claim 2, further comprising a first wing gear disposed in operable communication with a first wing and a second wing gear, the second wing gear disposed in operable communication with a second wing.

8. The system of claim 2, further comprising:

a slotted lever having a rotation point and a free end, the free end having an elongated slot configured to receive a crank pin attached to the second drive device; and a first wing gear disposed in operable communication with a first wing and a second wing gear, the second wing gear disposed in operable communication with a second wing;

wherein the slotted lever is disposed in operable communication with the first wing such that angular motion of the slotted lever drives the first wing in a flapping motion, thereby actuating the first wing gear, the second wing gear, and second wing such that the first wing and second wing flap in a corresponding motion.

9. A combined propulsion system and wing actuation assembly for a hovering toy creature, the combined system comprising:

a motor drive having a first motor unit for driving a first rotor, a second motor unit for driving a second rotor;

a first drive device;

a second drive device placed in operable communication with the first drive device, said second drive device configured to actuate two or more wings, thereby simulating a flapping motion; and a timer device configured to electrically activate and deactivate the motor drive.

10. The system of claim 9, wherein the timer device is operably connected to an activation device, and the activation device is configured to signal the timer device to activate the motor drive for a predetermined time period.

11. The system of claim 10, wherein the timer device is configured such that upon receiving a first signal from the activation device the timer device activates the motor drive for a first predetermined time period, and upon receiving a second signal from the activation device the timer device activates the motor drive for a second time period.

12. The system of claim 9, wherein the timer device is operably connected to an activation device, and the activation device is configured to signal the timer device to activate the first motor unit for a predetermined time period.

13. The system of claim 12, wherein the timer device is configured such that upon receiving a first signal from the activation device the timer device activates the first motor unit for a first predetermined time period, and upon receiving a second signal from the activation device the timer device activates the first motor unit for a second time period.

14. The system of claim 9, wherein the timer device is operably connected to an activation device, and the activation device is configured to signal the timer device to activate the first motor unit and the second motor unit for a predetermined time period.

15. The system of claim 10, wherein the timer device is configured such that upon receiving a first signal from the activation device the timer device activates the first motor unit and the second motor unit for a first predetermined time period, and upon receiving a second signal from the activation device the timer device activates the first motor unit and the second motor unit for a second time period.

* * * * *